US005823116A

United States Patent [19]

Williams

[11] Patent Number: 5,823,116

[45] Date of Patent: Oct. 20, 1998

[54] SHOCK-ABSORBING TOW BAR COUPLER

[76] Inventor: David F. Williams, 1275 N. Parker Dr., Janesville, Wis. 53545

[21] Appl. No.: 717,498

[22] Filed: Sep. 20, 1996

[51] Int. Cl.[6] ..... B61B 10/00; B61K 7/00

[52] U.S. Cl. ..... 104/172.5; 104/249; 104/250; 213/75 R; 188/82.1

[58] Field of Search ..... 104/172.1, 172.2, 104/172.3, 172.4, 249, 250, 251, 252; 105/3; 188/82.1, 82.4, 82.5; 213/7, 65 R, 64, 75 R; 280/504, 506

[56] References Cited

U.S. PATENT DOCUMENTS

| | | | |
|---|---|---|---|
| 3,871,277 | 3/1975 | Bolton . | |
| 4,467,725 | 8/1984 | Haldimann . | |
| 4,646,650 | 3/1987 | Kondo et al. | 104/172.3 |
| 4,665,832 | 5/1987 | Kobayashi et al. . | |
| 4,703,843 | 11/1987 | Dixon . | |
| 5,303,655 | 4/1994 | Summa et al. | 104/172.3 |
| 5,325,790 | 7/1994 | Drayer | 188/82.1 |
| 5,407,052 | 4/1995 | Heideman et al. | 104/172.3 |
| 5,485,912 | 1/1996 | Faitel et al. . | |
| 5,511,486 | 4/1996 | Pollard et al. | 213/62 R |
| 5,632,206 | 5/1997 | Summa et al. | 104/172.3 |

*Primary Examiner*—Mark T. Le
*Attorney, Agent, or Firm*—DeWitt Ross & Stevens S.C.

[57] ABSTRACT

A shock-absorbing tow bar coupler is disclosed. The tow bar coupler includes a housing dimensioned and configured at forward end to engage a trolley of a power and free conveyor. At its rearward end, a clevis is disposed within and rotatably attached to the housing. A hitch dimensioned and configured to engage a tow bar is rotatably attached to the clevis. The tow bar hitch provides a resilient, shock-absorbing attachment between the trolley and the tow bar.

21 Claims, 5 Drawing Sheets

SHOCK-ABSORBING TOW BAR COUPLER

FIELD OF THE INVENTION

The present invention is directed to a shock-absorbing coupling device for use in conveyor systems and assembly lines.

DESCRIPTION OF THE PRIOR ART

Beginning with the pioneering use of assembly line technology in the manufacture of automobiles, assembly line and material conveyor systems have become commonplace tools of modern mass-manufacturing.

One system widely used in the manufacture of automobiles is the power and free conveyor. In a power and free conveyor, a powered chain, cable, or other endless loop is situated in working arrangement with a set of tracks upon which a trolley rides. The trolley is attached to a tow bar, which is attached to a carrier, the carrier which carries a given workpiece. To move the trolley along the track, each trolley includes means to releasibly engage the powered chain.

The tracks which the trolley and its associated carrier move upon can be positioned either above or below the powered chain. In standard terminology, when the powered chain is situated below the tracks and the trollies ride along the track like a train, the conveyor is said to be an "inverted" power and free conveyor. When the powered chain is situated above the track and the trollies hang from the track like a cable car, the conveyor is referred to as an "upright" power and free conveyor. The term "power and free conveyor" is used herein to designate both types of conveyors. Additionally, the terms "assembly line(s)" and "conveyor (s)" and "conveyor system(s)" are used synonymously herein.

In operation, a power and free conveyor functions in substantially the same manner as a trolley car. The powered chain of the power and free conveyor is first set in motion at a constant speed. The trollies and their associated tow bars and carriers are then loaded onto the track and the means to releasibly engage the powered chain is activated, whereupon each trolley is urged forward along the track. Upon reaching a desired position on the track, a welding station for instance, the means to releasibly engage the powered chain is deactivated. Freed from the powered chain, the trolley and its associated carrier and workpiece remain stationary. The workpiece can then be acted upon as desired. Because the trollies themselves are not linked to each other, power and free conveyor systems provide tremendous assembly line manufacturing flexibility.

When conveying trollies through complex manufacturing processes, it is known to have the means to engage the powered chain on the trolley activated and deactivated based upon physical contact with another trolley. That is, when the track ahead is clear, the engagement means is automatically activated and the trolley, along with its tow bar and carrier, is moved forward by the powered chain. When the trolley is ultimately urged into contact with another trolley on the track, the engagement means is deactivated. In this way, a train-like string of trollies and carriers can be accumulated along the track.

The accumulation process is indispensable to the assembly line manufacturing process for a variety of reasons. Most importantly perhaps, accumulation allows a section of the assembly line to be shut down while the remainder of the line remains at full operational capacity. At the point of shut down, the trollies are accumulated along a side-track until the entire assembly line is restored to full operation.

Accumulation also allows for effective implementation of "just-in-time" manufacturing. Here, partially manufactured goods can be accumulated at critical junctures in the manufacturing process and acted upon when an order is placed.

One drawback to accumulating a large string of trollies on the track is that conventional power and free conveyors do not provide means for maintaining the trollies in their stationary positions during accumulation. Consequently, there is quite a bit of "jostling" between the accumulated trollies as they shift or roll backward on the track. This is further exacerbated as incoming trollies collide with the string of accumulated trollies.

Several patents describing power and free conveyor systems, as well as other conveyor mechanisms, can be found in the literature. See, for instance, U.S. Pat. No. 3,871,277, to Bolton, which describes a tracked walking gear for moving equipment along a track.

Haldimann, U.S. Pat. No. 4,467,725, describes a gravity-fed continuous shelf storage system which utilizes releasible engagement means to halt the advancement of pallets along a track.

Kobayashi et al., U.S. Pat. No. 4,665,832, describe a vehicle transfer system which moves an automobile under construction from one conveyor which carries the auto by its chassis, with the tire assemblies floating, to another conveyor which carries the auto upon its tires.

U.S. Pat. No. 4,703,843, to Dixon, describes a power and free conveyor apparatus for handing pallet-supported workpieces.

Faitel et al., U.S. Pat. No. 5,485,912, describes a latching mechanism for transportable welding pallets.

None of the above references are seen as describing the presently claimed tow bar coupler.

SUMMARY OF THE INVENTION

In a first embodiment, the present invention is directed to a shock-absorbing power and free conveyor tow bar coupler. The coupler comprises a housing having a forward end and a rearward end. The forward end of the housing includes means for releasibly fastening a trolley of a power and free conveyor. A clevis assembly is disposed within the rearward end of the housing and rotatably attached to the housing. Rotatably attached to the clevis assembly is means for releasibly fastening a tow bar. By utilizing this arrangement of parts, the trolley of the power and free conveyor is resiliently attached to the tow bar of the power and free conveyor via the rotatable attachment of the clevis to the housing.

In a second embodiment, the invention is further drawn to a shock-absorbing power and free conveyor tow bar coupler which comprises a housing having a forward end and a rearward end. In this embodiment, the forward end of the housing includes combined means for releasibly fastening a trolley of a power and free conveyor and means to prevent rearward movement of the trolley. As in the first embodiment, a clevis assembly is disposed within the rearward end of the housing and rotatably attached thereto. Rotatably attached to said clevis assembly is means for releasibly fastening a tow bar. As in the first embodiment, this arrangement of elements allows the trolley of the power and free conveyor to be resiliently and shock-absorbingly attached to the tow bar of the power and free conveyor.

In a third embodiment, the invention is drawn to a shock-absorbing power and free conveyor tow bar coupler comprising a housing having a forward end and a rearward end, the forward end of the housing including means for releasibly fastening a trolley of a power and free conveyor. A clevis assembly is disposed within the rearward end of the housing and rotatably attached to the housing. Means for releasibly fastening a tow bar are rotatably attached to the clevis assembly. Here, the invention further includes, in combination, means for releasibly fixing the means for releasibly fastening a tow bar in a stationary position. This arrangement allows the trolley of the power and free conveyor to be resiliently attached to the tow bar of the power and free conveyor. Additionally, the rotational movement afforded by the coupler can be arrested so that delicate and accurate manipulations, such as welding and painting, can be performed on the workpiece.

A fourth embodiment of the present invention is drawn to a coupler dimensioned and configured for use in power and free conveyors. Specifically, in an inverted power and free conveyor including a trolley riding upon a track, the trolley dimensioned and configured to engage a tow bar which bears a workpiece, the fourth embodiment of the invention is drawn to the improvement comprising a shock-absorbing tow bar coupler disposed between the trolley and the tow bar. As in the first embodiment, the coupler comprises a housing having a forward end and a rearward end. The forward end of the housing includes means for releasibly fastening a trolley of a power and free conveyor. A clevis assembly is disposed within the rearward end of the housing and rotatably attached thereto. Rotatably attached to said clevis assembly is means for releasibly fastening a tow bar, whereby the trolley of the power and free conveyor is resiliently attached to the tow bar of the power and free conveyor.

A problem widely encountered in power and free conveyor systems is that the linkage between the trolley and the tow bar is a rigid, inflexible coupling.

The present invention is a tow bar coupler which addresses this problem. The invention is a shock-absorbing or dampening tow bar coupler which provides rotational "give" when two trollies along a track collide or when a trolley is brought to an abrupt halt along the track, for instance, at a work station. In effect, the coupler acts as a pendulum to dampen the force of impact between trollies and their associated carriers. By dampening the force of a decelerating trolley, the operational life of the entire conveyor system is extended.

Additionally, the normal audio din of an operating assembly line is considerably reduced by using the present invention. For example, in the assembly of automobiles, trollies often carry a workpiece weighing more than two tons. In conventional power and free conveyors, these trollies collide into one another with a considerable crash. By dissipating the force of the initial contact between trollies and between trollies and stops along the assembly line, the present tow bar substantially reduces the overall noise level of large-scale assembly lines and conveyors.

Additionally, because the invention includes means for preventing rearward movement of trollies, accumulated trollies can be contained in tight registration within the smallest possible area. The tight physical contact between accumulated trollies also minimizes wear and tear on the trollies due to reduced "jostling" between the accumulated trollies and incoming trollies.

In light of the above, it is a principal aim of the invention to provide a shock-absorbing tow bar coupler which gently absorbs the impact between adjacent trollies or pallets carried on conveyors and assembly lines.

A more specific aim of the present invention is to provide a shock-absorbing tow bar coupler dimensioned and configured for use on inverted power and free conveyor systems.

A still further aim of the present invention is to provide a shock-absorbing tow bar coupler which includes means for preventing reverse travel of the trolley and tow bar to which the coupler is attached, thereby enabling stable accumulation of a string of adjacent trollies.

These and other aims, objects, and advantages of the tow bar coupler described herein will become apparent upon a complete reading of the following Detailed Description and claims, with reference being made to the attached drawing figures.

BRIEF DESCRIPTION OF THE DRAWINGS

Identical reference numerals are used throughout the various figures to designate the same or similar features of the tow bar coupler.

DETAILED DESCRIPTION OF THE INVENTION

Figure 1:
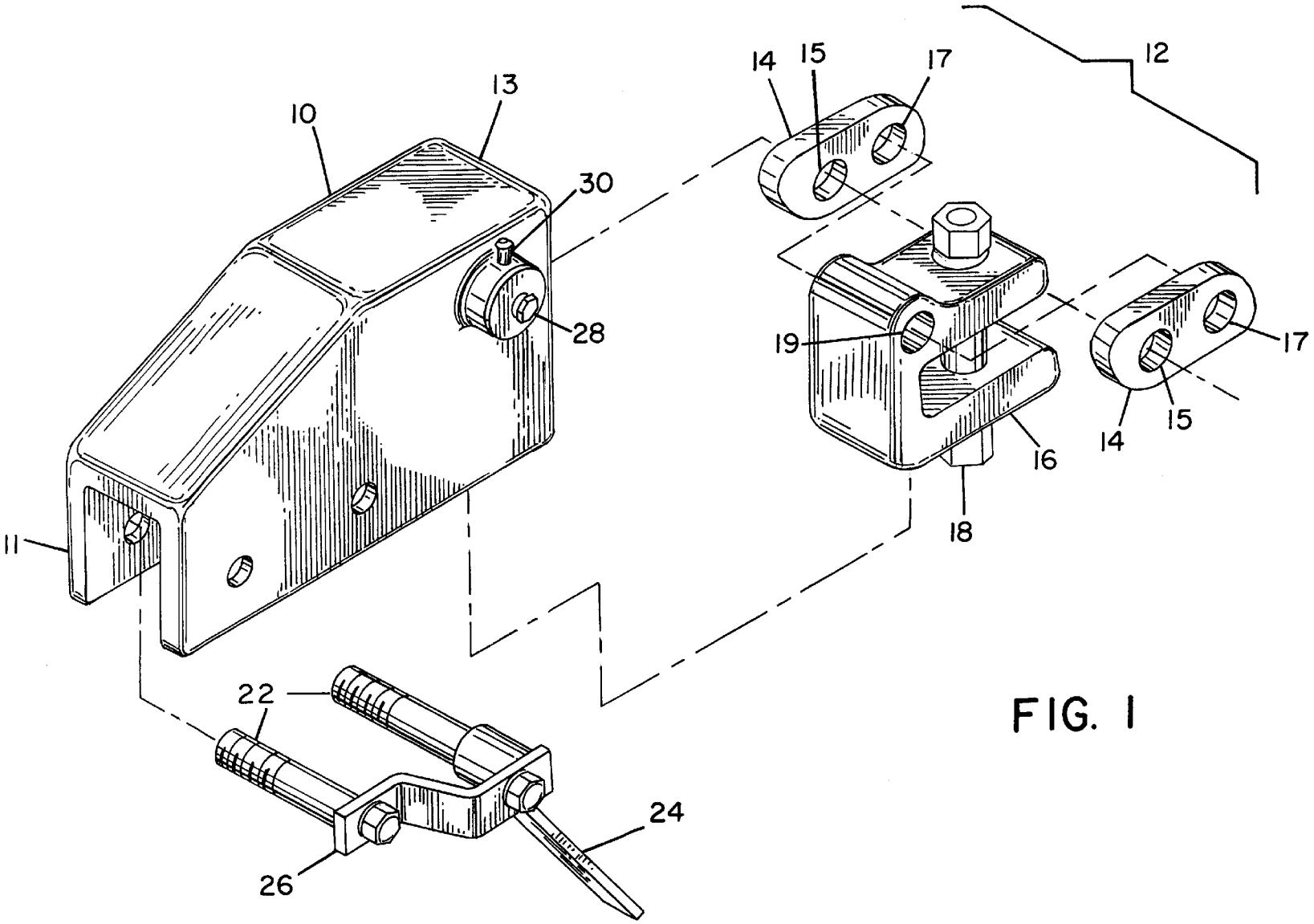
FIG. 1 is an exploded isometric rendering of an embodiment of the tow bar coupler according to the present invention.

Referring now to FIG. 1, which depicts an exploded perspective view of an embodiment of the subject tow bar coupler, the coupler includes a housing 10. The housing has a forward end 11 and a rearward end 13.

Figure 9:
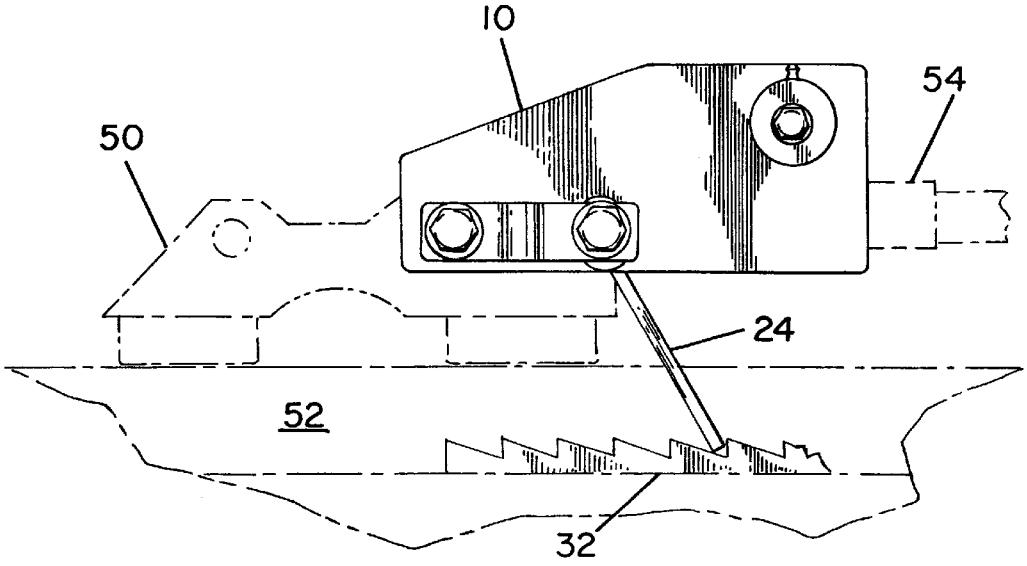
FIG. 9 is at right side elevation environmental view of an embodiment of the subject tow bar coupler in working relationship with an inverted power and free conveyor (shown in broken lines) and a length of sawtooth ratcheting, which depicts the operation of the anti-reverse sub-assembly.

Attached to the forward end of the housing 10 is means for releasibly fastening a trolley of a power and free conveyor. As shown in FIG. 1, these means are a pair of bolts 22 passing though the housing. With reference to FIG. 9, the bolts 22 are dimensioned and configured to releasibly fasten a trolley 50 (broken lines) of a power and free conveyor. While the bolts 22 are the preferred means for fastening, any equivalent means for releasibly fastening mechanical elements will function with equal success. Illustratively, the fastening means can be cotter pins, mollies, hook and eye fasteners, ball and cup fasteners, and the like. These and several other types of fastening means are well known to those skilled in the art.

Figure 5:
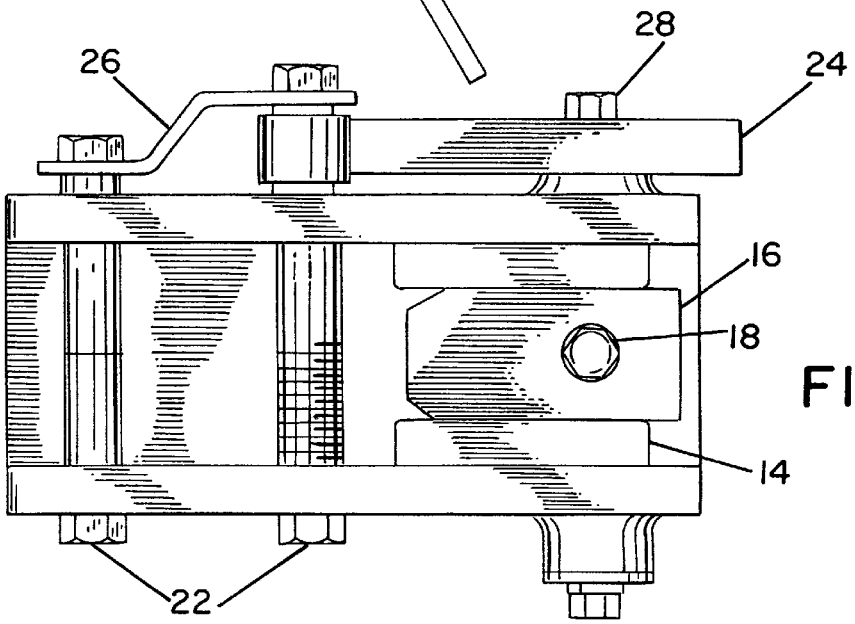
FIG. 5 is a bottom plan of the subject tow bar coupler as shown in FIG. 1.
Figure 7:
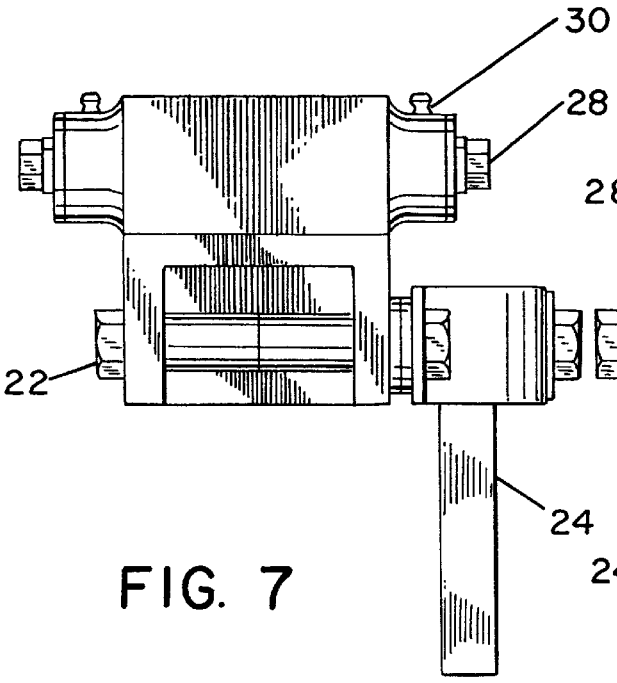
FIG. 7 is a front elevation of the subject tow bar coupler as shown in FIG. 1.
Figure 8:
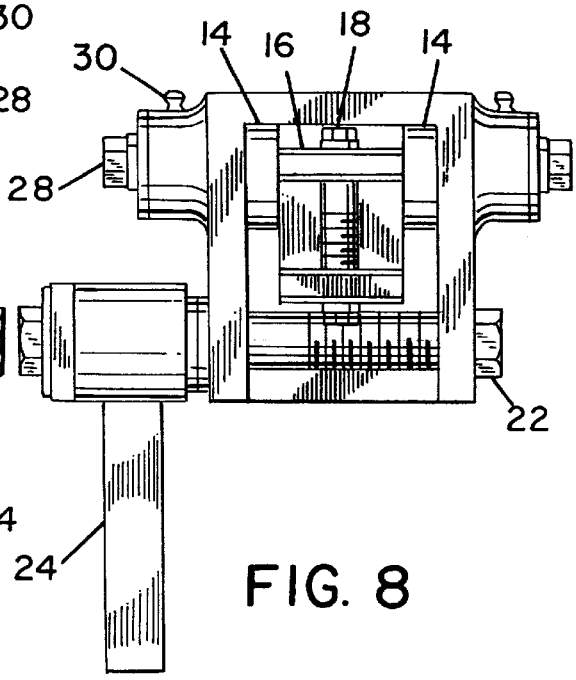
FIG. 8 is a rear elevation of the subject tow bar coupler as shown in FIG. 1.

A clevis assembly 12 is disposed within the rearward end 13 of the housing 10 and rotatably attached to the housing. As depicted in the drawing figures, the clevis assembly comprises first and second swing arms 14, each swing arm having a first aperture 15 and a second aperture 17 passing therethrough. The swing arms 14 are rotatably attached in registration to the housing through the first apertures 15 via bolts 28 passing through the housing. FIGS. 5, 7, and 8 provide a view of the back-side bolt 28 which is hidden from view in FIG. 1. The bolts 28 can be held in place by any suitable means, such as cap and screw 30.

Rotatably attached to the clevis assembly 12 is means for releasibly fastening a tow bar. As shown in the drawing figures, the means for fastening a tow bar takes the form of a C-shaped clevis 16 having a bolt 18 passing through the arms of the C-shaped portion of the clevis. The clevis 16 is rotatably attached through the second apertures 17 of the swing arms 14 of the clevis assembly 12 via an aperture 19 passing through the hitch. This is accomplished by conventional means such as a bolt, pin, or the like. The means by which the clevis 16 is rotatably attached to the clevis assembly 12 is not critical to the operation of the coupler so long as the attachment provides rotational movement of the clevis about the clevis assembly.

The bolts 28 and clevis assembly 12 may be used in conjunction with suitable and well known friction and wear-reducing means such as replaceable bushings, washers, and the like. Such well known devices extend the operational lifetime of friction-bearing surfaces and are conventionally used in all mechanical devices. Likewise, the various friction-bearing surfaces may be lubricated with oil, grease, teflon bushings, and the like, to reduce overall wear on the invention.

Figure 2:
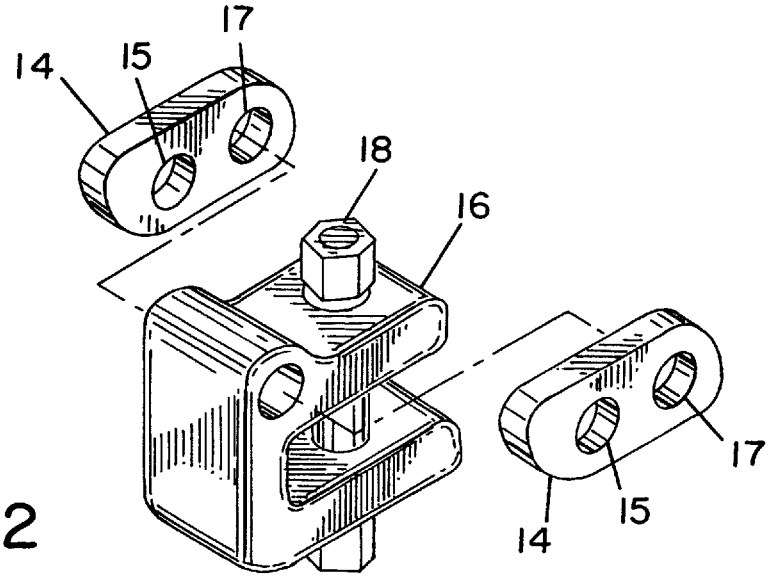
FIG. 2 is an isolated isometric rendering of the clevis sub-assembly of the subject tow bar coupler as shown in FIG. 1.
Figure 3:
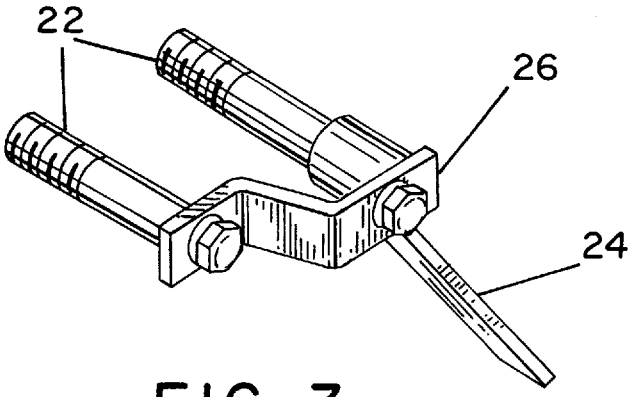
FIG. 3 is an isolated isometric rendering of the anti-reverse sub-assembly of the subject tow bar coupler as shown in FIG. 1.
Figure 4:
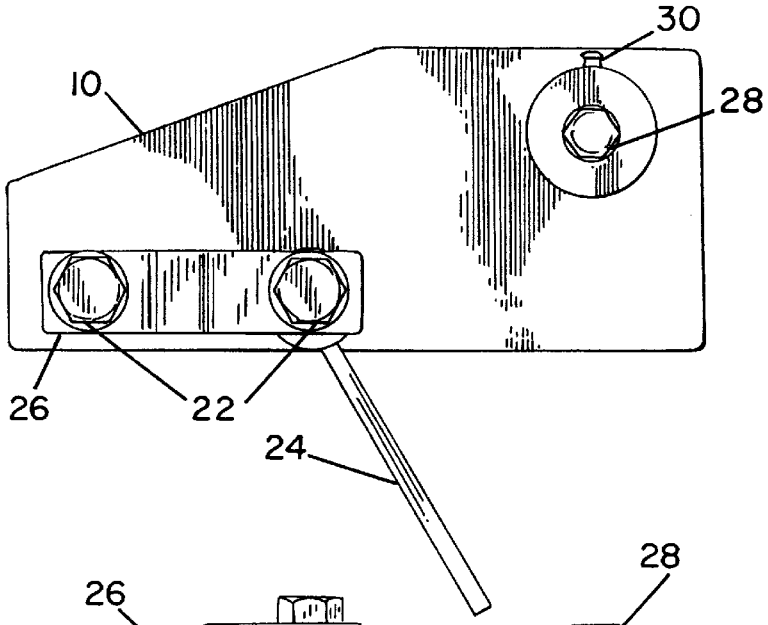
FIG. 4 is a right side elevation of the subject tow bar coupler as shown in FIG. 1.
Figure 6:
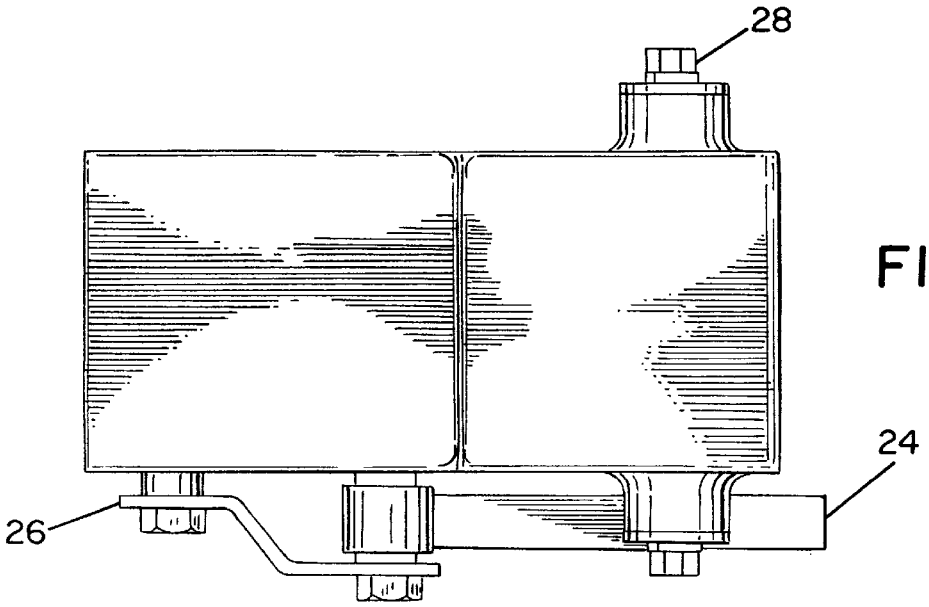
FIG. 6 is a top plan rendering of the subject tow bar coupler as shown in FIG. 1.

FIGS. 2 and 3 depict isolated views of the clevis assembly 12 and clevis 16, and the means for releasibly fastening a trolley to the coupler, respectively. FIG. 4 depicts a right side elevation of the coupler depicted in FIG. 1 as it appears when fully assembled. FIGS. 5 and 6 depict bottom and top plan views of the coupler shown in FIG. 1, respectively. FIGS. 7 and 8 depict a front elevation and a rear elevation of the coupler depicted in FIG. 1, respectively. Identical reference numerals are used throughout the drawing figures.

Referring now to drawings 1 and 3 through 9, another embodiment of the subject tow bar coupler further includes means to prevent rearward movement of the linked trolley, coupler, and tow bar along the power and free conveyor track. As shown throughout the drawings figures, the means to prevent rearward movement is an anti-reverse dog 24 in operational combination with a sawtooth ratchet 32 (see FIG. 9).

With specific reference to FIG. 9, this drawing figure depicts the operation of the subject coupler in conjunction with a power and free conveyor. The trolley 50, the tow bar 54, and the conveyor track 52 of the conveyor system form no part of the present invention and are therefore depicted in broken lines. The dog 24 is attached to the housing and the sawtooth ratchet 32 is fixedly disposed along a path followed by the dog 24 and in contact with the dog. The dog 24 is rotatably attached to the housing 10 within a constrained range of motion which allows for only unidirectional travel of the linked trolley 50, coupler, and tow bar 54 along the track 52 of a conveyor. As shown in FIG. 9, the dog and sawtooth ratchet combination will allow the trolley to move only from right to left. Motion from left to right will be arrested by the engagement of the dog 24 with the sawtooth ratchet 32.

As shown throughout the drawing figures, the means for releasibly fastening the coupler to the trolley and the means to prevent rearward movement of the trolley can be combined into a single subassembly. As shown in FIG. 1, the dog 24 can be mounted to one of the bolts 22 of the fastening means. A limit bar 26 functions to constrain the rotational motion of the dog so that it will function to prevent rearward motion of the trolley to which the coupler is attached.

Figure 10:
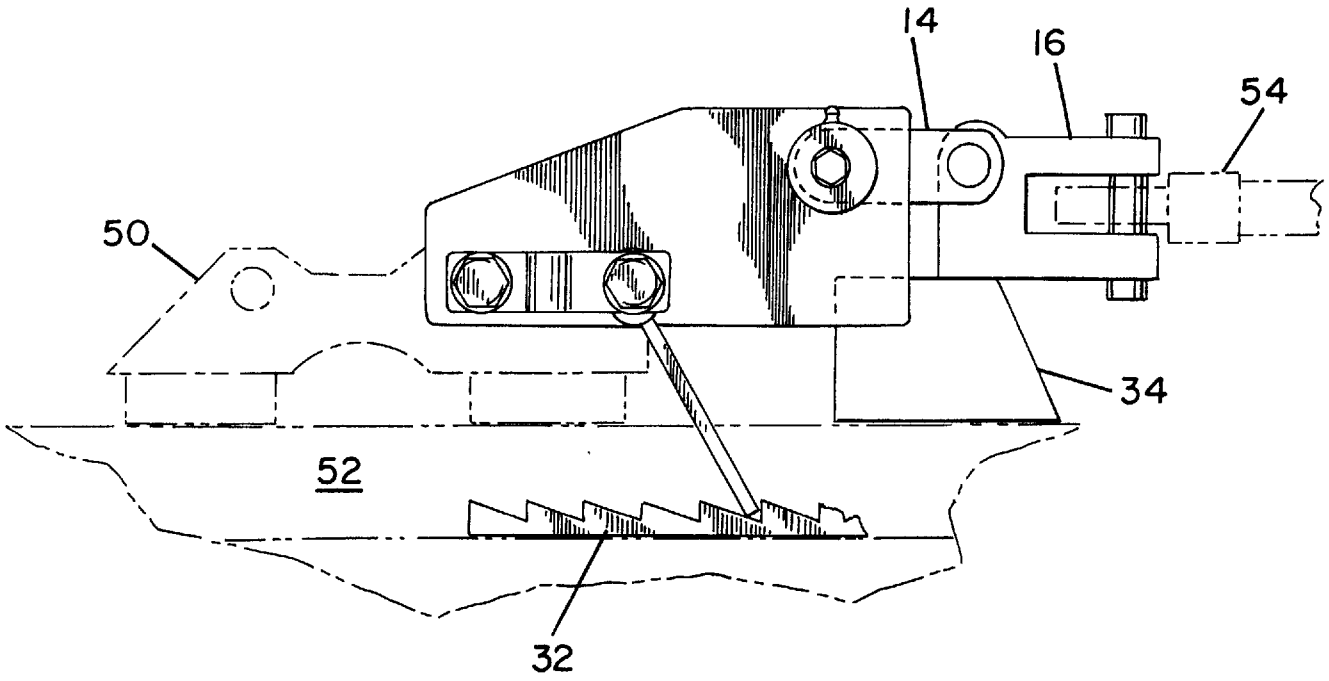
FIG. 10 is at right side elevation environmental view of an embodiment of the subject tow bar coupler in working relationship with an inverted power and free conveyor (shown in broken lines) and a cam which releasibly holds the clevis assembly and clevis in a fixed, stationary position.

Referring now to FIG. 10, this figure depicts an embodiment of the invention which includes, in combination, means 34, for releasibly maintaining the clevis assembly 12 and clevis 16 in a fixed, stationary position. As shown here, the means 34 is a ramped cam operationally disposed to contact the clevis 16, yet remain clear of the trolley, tow bar, and carrier (not shown). In operation, the cam 34 functions to hold the clevis assembly and clevis is a fixed, stationary position so that there is no rocking motion between the trolley and the carrier. This fixed, stationary positioning is essential when delicate and precise operations are to be performed on the workpiece resting upon the carrier. For example, the cam 34 could be placed along the track at a workstation (such as a painting or welding workstation). The cam 34 is placed at such a position that when the trolley halts at its designated place in the workstation, the clevis rides onto the cam and is effectively locked into position by forcible contact with the cam 34, which prevents rotational movement of the clevis assembly and clevis. In this manner, the workpiece can be maintained in a fixed, stationary position so that precise manipulations can be performed on the workpiece. When the trolley moves forward (to the left as shown in FIG. 10), the clevis will fall off of the cam 34 and again be free to rotate and dampen collisions between trollies.

All of the elements of the invention are preferably fabricated from suitably durable materials, such as case-hardened or structural steel, and the like. The various parts may be cast or milled or otherwise fabricated in any manner known to the art, such means of fabrication not being critical to the operation of the invention. The materials should be able to withstand extreme temperatures regularly encountered in manufacturing operations, as well as caustic conditions of high acidity or alkalinity.

It is understood that the subject tow bar coupler is not confined to the particular construction and arrangement of parts herein illustrated and described, but embraces all modified forms thereof which fall within the scope of the following claims.

What is claimed is:

1. A shock-absorbing power and free conveyor tow bar coupler comprising:

a housing having a forward end and a rearward end, the forward end of said housing including means for releasibly fastening a trolley of a power and free conveyor;

a clevis assembly disposed within the rearward end of said housing and rotatably attached thereto by a first means for rotatable attachment; and means for releasibly fastening a tow bar, said means rotatably attached to said clevis assembly by a second means for rotatable attachment.

2. The tow bar coupler of claim 1, further comprising means to prevent rearward movement of the trolley and tow bar along the power and free conveyor.

3. The tow bar coupler of claim 2, wherein the means to prevent rearward movement is an anti-reverse dog in operational combination with a sawtooth ratchet, said dog attached to said housing and said sawtooth ratchet fixedly disposed along a path followed by the dog and in contact therewith.

4. The tow bar coupler of claim 1, wherein said clevis assembly comprises a first and a second swing arm each having a first and a second aperture passing therethrough, the first and second swing arms rotatably attached in registration to said housing through said first apertures and rotatably attached to said means for releasibly fastening a tow bar through said second apertures.

5. The tow bar coupler of claim 1, wherein said means for releasibly fastening a tow bar is a C-shaped clevis.

6. A shock-absorbing power and free conveyor tow bar coupler comprising:

a housing having a forward end and a rearward end, the forward end of said housing including combined means for releasibly fastening a trolley of a power and free conveyor and means to prevent rearward movement of the trolley;

a clevis assembly disposed within the rearward end of said housing and rotatably attached thereto by a first means for rotatable attachment; and means for releasibly fastening a tow bar, said means rotatably attached to said clevis assembly by a second means for rotatable attachment.

7. The tow bar coupler of claim 6, wherein the means to prevent rearward movement is an anti-reverse dog in operational combination with a sawtooth ratchet, said dog attached to said housing and said sawtooth ratchet fixedly disposed along a path followed by the dog and in contact therewith.

8. The tow bar coupler of claim 6, wherein said clevis assembly comprises a first and a second swing arm each having a first and a second aperture passing therethrough, the first and second swing arms rotatably attached in registration to said housing through said first apertures and rotatably attached to said means for releasibly fastening a tow bar through said second apertures.

9. The tow bar coupler of claim 6, wherein said means for releasibly fastening a tow bar is a C-shaped clevis.

10. A shock-absorbing power and free conveyor tow bar coupler comprising:

a housing having a forward end and a rearward end, the forward end of said housing including means for releasibly fastening a trolley of a power and free conveyor;

a clevis assembly disposed within the rearward end of said housing and rotatably attached thereto by a first means for rotatable attachment; and means for releasibly fastening a tow bar, said means rotatably attached to said clevis assembly by a second means for rotatable attachment;

in combination with means for releasibly fixing said means for releasibly fastening a tow bar in a stationary position.

11. The tow bar coupler of claim 10, wherein said means for releasibly fixing is a cam, said cam operationally disposed to releasibly engage said means for releasibly fastening a tow bar, whereby rotational movement of said means for releasibly fastening a tow bar is prevented.

12. The tow bar coupler of claim 10, further comprising means to prevent rearward movement of the trolley and tow bar along the power and free conveyor.

13. The tow bar coupler of claim 12, wherein the means to prevent rearward movement is an anti-reverse dog in operational combination with a sawtooth ratchet, said dog attached to said housing and said sawtooth ratchet fixedly disposed along a path followed by the dog and in contact therewith.

14. The tow bar coupler of claim 10, wherein said clevis assembly comprises a first and a second swing arm each having a first and a second aperture passing therethrough, the first and second swing arms rotatably attached in registration to said housing through said first apertures and rotatably attached to said means for releasibly fastening a tow bar through said second apertures.

15. The tow bar coupler of claim 10, wherein said means for releasibly fastening a tow bar is a C-shaped clevis.

16. The tow bar coupler of claim 15, wherein said means for releasibly fixing is a cam, said cam operationally disposed to releasibly engage said C-shaped clevis, whereby rotational movement of said hitch is prevented.

17. In an inverted power and free conveyor including a trolley riding upon a track, the trolley dimensioned and configured to engage a tow bar which bears a workpiece, the improvement comprising a shock-absorbing tow bar coupler disposed between the trolley and the tow bar, said coupler comprising:

a housing having a forward end and a rearward end, the forward end of said housing including means for releasibly fastening a trolley of a power and free conveyor;

a clevis assembly disposed within the rearward end of said housing and rotatably attached thereto by a first means for rotatable attachment; and means for releasibly fastening a tow bar, said means rotatably attached to said clevis assembly by a second means for rotatable attachment.

18. The tow bar coupler of claim 17, further comprising means to prevent rearward movement of the trolley and tow bar along the power and free conveyor.

19. The tow bar coupler of claim 18, wherein the means to prevent rearward movement is an anti-reverse dog in operational combination with a sawtooth ratchet, said dog attached to said housing and said sawtooth ratchet fixedly disposed along a path followed by the dog and in contact therewith.

20. The tow bar coupler of claim 17, wherein said clevis assembly comprises a first and a second swing arm each having a first and a second aperture passing therethrough, the first and second swing arms rotatably attached in registration to said housing through said first apertures and rotatably attached to said means for releasibly fastening a tow bar through said second apertures.

21. The tow bar coupler of claim 17, wherein said means for releasibly fastening a tow bar is a C-shaped clevis.

* * * * *